US010507378B2

(12) United States Patent
Spigner

(10) Patent No.: US 10,507,378 B2
(45) **Date of Patent: *Dec. 17, 2019**

(54) LIVE ACTION MULTI-TRACK SKILLS GAME

(71) Applicant: Boda Borg Corp., Laguna Hills, CA (US)

(72) Inventor: David L. Spigner, Laguna Hills, CA (US)

(73) Assignee: Boda Borg Corp., Laguna Hills, CA (US)

( * ) Notice: Subject to any disclaimer, the term of this patent is extended or adjusted under 35 U.S.C. 154(b) by 24 days.

This patent is subject to a terminal disclaimer.

(21) Appl. No.: 14/540,887

(22) Filed: Nov. 13, 2014

(65) Prior Publication Data

US 2015/0069710 A1 Mar. 12, 2015

Related U.S. Application Data

(63) Continuation of application No. 13/609,861, filed on Sep. 11, 2012, now Pat. No. 8,888,575, which is a (Continued)

(51) Int. Cl.
*A63F 9/18* (2006.01)
*A63F 9/00* (2006.01)
(Continued)

(52) U.S. Cl.
CPC ..... *A63F 9/18* (2013.01); *A63F 9/0073* (2013.01); *A63F 9/0078* (2013.01); *A63G 33/00* (2013.01); *A63F 3/00097* (2013.01); *A63F 7/04* (2013.01)

(58) Field of Classification Search
CPC .. A63F 13/00; A63F 13/10; A63F 9/24; A63F 13/80; A63F 13/822; A63F 13/24;
(Continued)

(56) References Cited

U.S. PATENT DOCUMENTS 5,320,362 A * 6/1994 Bear et al. ..... 463/5
5,393,074 A * 2/1995 Bear ..... A63F 9/0291 273/440

(Continued)

FOREIGN PATENT DOCUMENTS

EP 0980698 B1 10/2007

OTHER PUBLICATIONS

"Legends of the Hidden Temple, Final Round: The Temple Run, Game Show, Original Air Date: Sep. 11, 1993", Jul. 5, 2017, retrieved from https://web.archive.org/web/20170705021552/https://en.wikipedia.org/wiki/Legends_of_the_Hidden_Temple on Jul. 11, 2017, 4 pages.

(Continued)

*Primary Examiner* — Chase E Leichliter
(74) *Attorney, Agent, or Firm* — KPPB LLP

(57) ABSTRACT

A system and method for operation of a game in which teams of players attempt to negotiate through a track of rooms, or several tracts of rooms. Teams attempt to progress through the track by solving problems presented in each room thereby earning access to a following room, until the team completes a track comprising several rooms. A control system is operable to control flow of teams from room to room, and to control presentation of problem solving activities to the teams, and to interpret data from the rooms to assess the performance of the team, and grant access to a following room or to bar access to a following room and/or eject the team from the room to start over on the track.

20 Claims, 1 Drawing Sheet

Related U.S. Application Data continuation of application No. 12/235,435, filed on Sep. 22, 2008, now Pat. No. 8,262,445.

(60) Provisional application No. 60/974,216, filed on Sep. 21, 2007.

(51) Int. Cl.

| | |
|---|---|
| ***A63G 33/00*** | (2006.01) |
| *A63F 3/00* | (2006.01) |
| *A63F 7/04* | (2006.01) |

(58) Field of Classification Search

CPC .. A63F 9/0078; A63F 9/0079; A63F 3/00097; A63F 7/04

USPC ..... 463/1, 9, 15, 42; 273/440, 153 R

See application file for complete search history.

(56) References Cited

U.S. PATENT DOCUMENTS

| | | | | |
|---|---|---|---|---|
| 5,679,075 | A * | 10/1997 | Forrest et al. | 463/9 |
| 5,853,332 | A * | 12/1998 | Briggs | 472/128 |
| 6,634,949 | B1 * | 10/2003 | Briggs et al. | 463/42 |
| 6,675,538 | B2 | 1/2004 | Candio | |
| 6,855,062 | B1 * | 2/2005 | Truong | A63J 11/00 472/134 |
| 7,373,377 | B2 * | 5/2008 | Altieri | 709/203 |
| 7,614,958 | B2 | 11/2009 | Weston et al. | |
| 7,628,697 | B2 | 12/2009 | Tanaka | |
| 7,749,089 | B1 * | 7/2010 | Briggs et al. | 472/136 |
| 2003/0106455 | A1 * | 6/2003 | Weston | A63G 7/00 104/53 |
| 2003/0198923 | A1 * | 10/2003 | Westra | E04B 2/827 434/226 |
| 2004/0033833 | A1 * | 2/2004 | Briggs | A63G 31/00 463/42 |
| 2004/0077423 | A1 * | 4/2004 | Weston | A63G 31/00 472/137 |
| 2006/0287030 | A1 * | 12/2006 | Briggs et al. | 463/9 |
| 2007/0037566 | A1 * | 2/2007 | D'Agostino | G07C 9/00896 455/421 |
| 2007/0191096 | A1 | 8/2007 | Tanaka | |
| 2007/0265071 | A1 * | 11/2007 | Ziemkowski | A63F 13/06 463/34 |
| 2008/0182664 | A1 * | 7/2008 | Kaplan | A63F 3/00 463/42 |

OTHER PUBLICATIONS

"Office Action Summary", U.S. Appl. No. 12/235,435, dated Sep. 2, 2011, 7 pages.

International Search Report for International Application No. PCT/US2009/057513, Search completed Apr. 8, 2010, dated Apr. 9, 2010, 3 pgs.

* cited by examiner

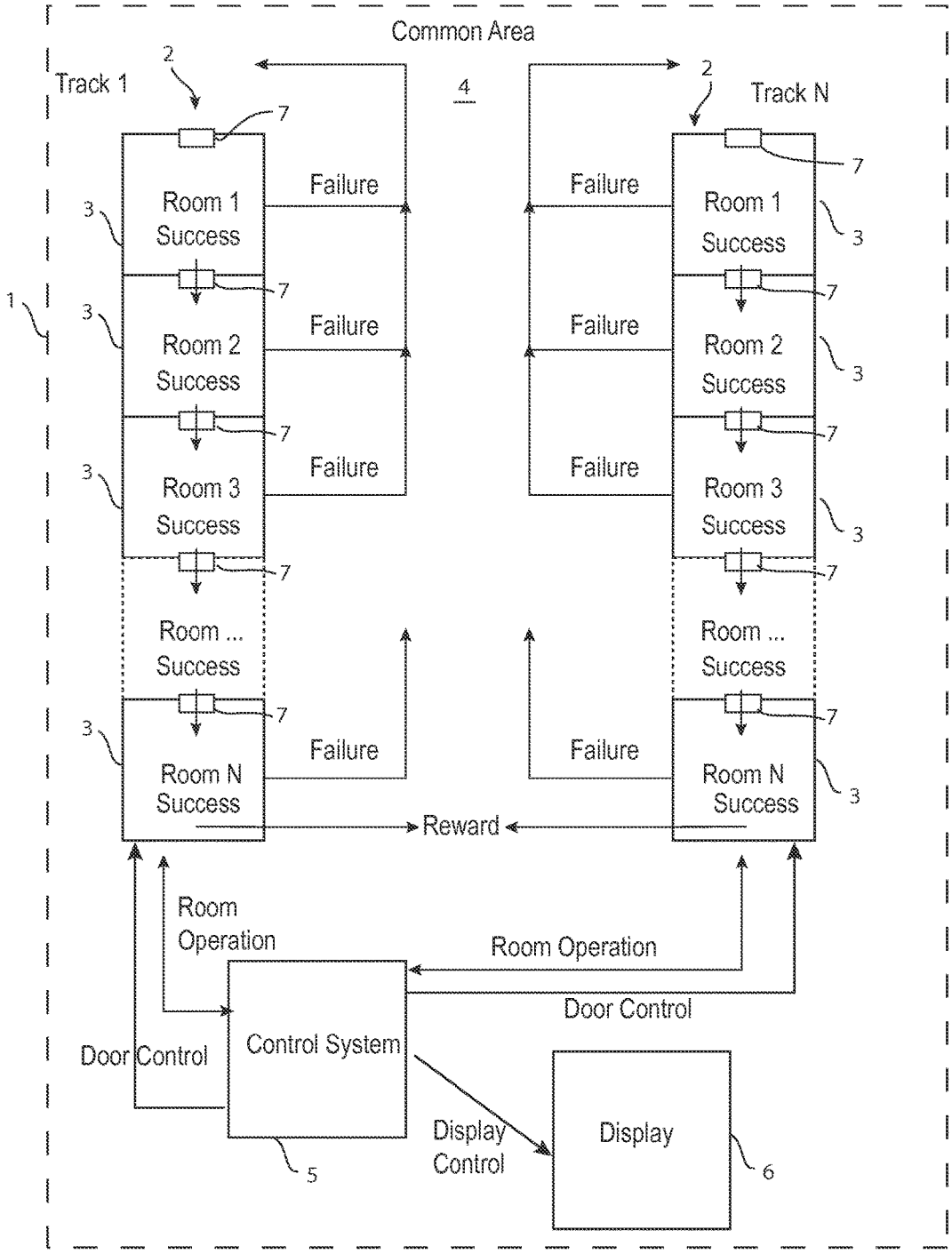
Common Area
4
Track 1
Track N
2
2
7
Room 1
Success
Failure
Room 2
Success
Failure
Room 3
Success
Failure
Room ...
Success
Room N
Success
Failure
Reward
1
3
Room
Operation
Room Operation
Door Control
Door Control
Control System
5
Display
Control
Display
6

LIVE ACTION MULTI-TRACK SKILLS GAME

This application is a continuation of U.S. patent application Ser. No. 13/609,861 entitled "Live Action Multi-Track Skills Game" to Spigner, filed Sep. 11, 2012, which application is a continuation of U.S. patent application Ser. No. 12/235,435, entitled "Live Action Multi-Track Skills Game" to Spigner, filed Sep. 22, 2008, now U.S. Pat. No. 8,262,445, which claims priority to U.S. Provisional Patent Application Ser. No. 60/974,216 filed Sep. 21, 2007, all of which are hereby incorporated by reference as if set forth herewith.

FIELD OF THE INVENTIONS

The present invention relates to games.

BACKGROUND OF THE INVENTIONS

European Patent 99115726 discloses a system for game play in which players attempt to proceed through a series mental or physical challenges. The challenges are presented to the players of in a series of rooms, and players address a challenge in each room, and progress through the rooms is automatically controlled in response to devices which sense the successful completion of a task. The system has been implemented in various locations in Sweden.

SUMMARY

The system and methods described below provide for operation of a game in which teams of players attempt to negotiate through a track of rooms, or several tracts of rooms. Teams attempt to progress through the track by solving problems presented in each room and thereby earning access to a following room, until the team completes a track comprising several rooms. A control system is operable to control flow of teams from room to room, and to control presentation of problem solving activities to the teams, and to interpret data from the rooms to assess the performance of the team, and grant access to a following room or to bar access to a following room and/or eject the team from the room to start over on the track. Various aspects of the system enhance the game play, as described below.

BRIEF DESCRIPTION OF THE DRAWINGS

The FIGURE is a schematic diagram of a game facility.

DETAILED DESCRIPTION OF THE INVENTIONS

The game is preferably played in small teams. The teams may play in isolation, or may compete with other teams. The game is played in a large multi-room facility 1 illustrated in the FIGURE. In play, teams progress through the tracks 2, which comprise a number of rooms 3, room-by-room, by entering a first room and ascertaining a task to be carried out, and successfully completing that task in order to gain access to a second room and ascertaining a task to be carried out, and successfully completing that task in order to gain access to a yet another room, and so on until the track is complete. Failure to complete a task in any one room results in ejection from the track, in which case the team is directed to the beginning of the track (the first room), through the common area 4, to start working through the track from the beginning.

Failure can be assessed either by improper completion of the task, or failure to complete the task in a predetermined time period. The object of the game is to advance through one or more tracks (small groups of rooms), as quickly as possible, or while accomplishing a large number of tasks. Upon successful completion of a track, teams exit the track. As indicated in the FIGURE, a control system 5 is used to control access to the various rooms in various tracks, and to operate the rooms, including configuration of problem solving activities in each room and analysis of inputs from teams to determine successful completion of a task or failure to complete a task, and operation of displays 6 throughout the building to keep teams apprised of their progress, and operation of various doors 7 to allow and/or compel teams to move according to the game outline as determined by the game programmers.

The tasks can include problem solving activities of any type, including educational puzzles to be completed, trivia questions, educational activities in any discipline, physical and athletic challenges, etc. Preferably, the tasks require cooperation amongst the team members. In one example, a team may be tasked with repeating, by dance steps, activation of floor pads or buttons in imitation of a displayed pattern of illumination, in which case the computer controlling the activity would illuminate floor pads in a random sequence to teach the sequence to the team, and the team would then step on pads in the same sequence. The task can also be dictated on a display screen, and operated similarly to the popular Dance Dance Revolution® game. To make cooperation necessary, the pads would be physically located, and the computer controlling the game operated, such that it would activate the pads in a sequence, such that it would be difficult or impossible for a single team member to step on the pads in the same sequence, but easy, or mildly challenging, for several members of the team to do so. In another example, a team may be tasked with simultaneous or serial operation of, or contact with, physical icons mounted in the room, or virtual icons displayed on display screens in the room, in response to prompts or clues provided in the room. The prompts may be, for example, a globe with a country or region distinguished (by illumination or otherwise) in the center of the room, and the icons may be displayed images of numerous landmarks from the distinguished region and other regions, and the team may be tasked with touching or otherwise manipulating those icons that match the distinguished region, preferably spaced so far apart, or in such number, that all members of the team must participate to succeed. A large variety of such games may be implemented in each room.

Modification of Skill Levels

The control system can be programmed to assess the skill level of various teams, in various disciplines, and adjust the difficulty of tasks or subject area of tasks to be completed by each team. Thus, for example, if a team is progressing rapidly through a track, with little difficulty in educational puzzles, the control system can present ever more difficult puzzles to that team, or vary the discipline covered by puzzles in following rooms, or redirect the team to a more difficult track or side-track. If a team is progressing slowly, the control system can modify the tasks to make them easier, or redefine success such that some level of partial completion of the task earns the team passage to following rooms. If a team has re-entered a room after ejection, for example, the system may provide clues, provide more time, or ease the physical challenge presented by a room if the team has already been ejected several times. Then again, if the teams intend to play a more difficult game, the control system can be operated to present the same game to a re-entrant team until they successfully complete the task originally presented.

The control system can also be programmed to modify physical and athletic challenges to suit the number of members in a team. In the example given above regarding stepping sequences, the control system can display stepping sequences which require simultaneous contact with floor pads by a single person or by several people (for example, require serial contact of pads closely spaced to challenge one person, or require simultaneous contact of several widely spaced pads to challenge several people).

Dependent Room Configurations

To avoid coaching of one team by another, or spying for hints from one team by another, the control system can be operated to present a different challenge to teams based on their proximity to re-entrant teams. When teams are ejected from a room, they must re-enter the track at the first room and work through all the rooms of the track again. (This is accomplished by instructing players to do so, or by the control system in response to tracking information as described below). If new teams are waiting to enter the track when a team that has recently been ejected from the track appears at the entry (as determined, for example, by the player tracking described below), the control system will present a challenge to the new team that differs from the challenge previously presented to the ejected team, so that the ejected team cannot describe the challenge to the new team in manner that provides any benefit to the new team. In this manner, also, discussions between two ejected teams waiting together to re-enter the track are rendered fruitless, because the control system can identify the teams, determine the challenge each team faced in previous runs through the track, and operate the rooms to present new challenges as needed to render any passage of hints or cheats useless. For example, if two teams in the entry area were both ejected from room 3 of the track after being presented with the same challenge, the control system can operate room 3 to present new challenges to each of those teams, so that any exchange of information regarding their previous challenge in room 3 is not useful in answering the challenge presented by room 3 in the next run through the track. Alternatively, the control system may operate to present one of several different challenges in room 3 to each new group, such that groups proximate each other are presented with different challenges. In this way also, groups that are likely to be ejected from a room will gain no information from the room that might be useful to solving another groups challenge in that room.

The control system is thus programmed to determine the proximity of two or more teams, or members of said two or more teams, after barring entry to an additional room and thus compelling exit from the room and starting the track anew, to permit entry to each team to rooms previously accessed by each team, but to reconfigure the problem solving activity in the room or rooms previously accessed by each team to require different challenges or different responses to similar challenges. In this manner, the control system nullifies any information exchanged between two or more teams for the purpose of resolving the challenge presented in the rooms previously accessed by each team.

Tracking of Players

Each player or team is provided with a key, fob, wristband or other token, which is also necessary to play the game. The token may be imprinted with team identification information, which may be stored in any storage media such as a magnetic strip or RFID tag. The control system is programmed to track teams, and store information regarding the location of the team with the track, and the location of the team with regard to various tracks. The control system posts information on displays readily accessible to all teams, for example on a display in each room and on displays in common areas between tracks. Also, the control system uses this information to identify teams as they re-enter tracks after ejection, and thereafter control the challenges presented so that a team is presented with the same challenges in the room from which they were ejected, the same or different challenges in the rooms they have already successfully negotiated (depending on the desired level of difficulty). The control system can compel teams to restart a track from the first room of the track by providing access to the first room based on the tracking information and denying access to follow-on room based on the tracking information (the tracks may be built such that each track can be accessed only through the first room, and each follow-on room can only be accessed from the immediately preceding room in the track, in which case this feature would enforced by the building architecture). Team tracking information may be used to control traffic flow through the track, and between various tracks, in conjunction with control system configuration of the rooms, the challenges presented in the rooms, and manipulation of the sequence of progress through rooms and tracks. For example, if a team has been particularly adept, or particularly slow, in progressing through a track, the control system can, upon completion of the track (or at an intermediate room within the track), direct the team to another track which is more or less challenging, and thereafter identify that redirected team when they arrive at the assigned new track, and/or adjust the level of play to suit the team's ability as determined in the previous track or tracks.

Diversion to Other Tracks

Upon successful completion of a task, teams may be granted access to the next room in the track, or, in the alternative, may be provided with a clue, key or token necessary to gain access to another track. Also, to complete a task in a room of one track, it may be necessary to present information, a token or game piece acquired from another room in the same track or a different track. By controlling the challenges presented in various rooms, the system can require teams to back-track within the same track, or divert themselves to another track, to obtain the information or token, and then return to the original room to complete the task. The tokens may be identified through electronic means (RFID, magnetic strip, computer ID chip, etc.), and the information may include many different pieces of information (the name of a character in another track, or the color of an object in another room, and these may be changed periodically so that the team cannot rely on previous trips to the diversion track but must visit the diversion track reasonably contemporaneously with the challenge). The information can also comprise digital information stored on the teams identification card or fob by a suitable electronic input (card writer, for example) located in the diversion track. The system can, by identification and tracking of the team, determine suitably challenging time frames for the required freshness of the information, so that, for example, if the team plays the game in several sessions in the same day, the token or information gleaned from visit to the diversion track during the same day or same week will be fresh, and will be useful to complete the task, but information from a long ago run through the diversion track will not. If desired, the control system may also divert teams to activities outside the game building, for example to find a token or piece of information. Also, the control system can be operated such that return with the token is optional, but highly rewarded in the scoring system of the game.

This mode of operation is achieved by programming the control system to demand, as part of a solution in a room of one track, that a team present a token or provide information that the control system provides in response to successful completion of a task in a room of another track. The control system in this case will operating two or more tracks, with each track comprising a plurality of rooms presenting a distinct set of problem solving activities.

The control system may also operate to require teams to communicate with other teams, and cooperate with other teams, on a bilateral or unilateral basis, to address a challenge. For example, the system may demand information which can only be obtained from another team as it is contemporaneously displayed to the other team, in which case communications are established by the control system (or independently, by cell-phone) with the other team, or the system may demand coordination of actions with the other team, in order for one or both teams to succeed in addressing its challenge and earn access to the next room.

Music:

The control system can be operated, in conjunction with a music system, to play music or sound effects in the various rooms, and alter the music in response to the apparent progress of a team. The sound may become more intense and dramatic, deeper or louder, softer or change pitch and tempo to add a sense of scoring team activity in the room. In the example given above regarding stepping sequences, the control system can play music which varies in response to the speed, or which is controlled by the speed at which the team members negotiate the dictated stepping sequence. In other examples, the system may provide fast paced music or loud disruptive music in a room which challenges a team with a logic puzzle, to increase the difficulty of solving the puzzle, or the system may play a short fanfare whenever a team makes progress in assembling parts of a physical puzzle to encourage the puzzle.

Additional Obstacles and Rewards

An additional obstacle can be presented to each team, so that the team must enter a password, answer a trivia question or riddle, before the control system grants access to the next room. The passwords and/or trivia question answers may correlate to activities of the challenge (for example, the answer may be been disclosed by the control system, to the team as it addressed the challenge presented in the room) to reinforce or supplement an educational point of the challenge. Also, an additional reward can be offered at various points in a track for successful completion of a task. Rewards can includes stamps for children to complete a stamp book, additional time allotment to solve a later challenge, or information necessary to solve a problem related to a training session operated by users in conjunction with the game play.

Control System

Access to the game is controlled by a control system, which is used by an operator to issue tickets to teams on demand. The control system and suitable output devices provide tickets in the form of a keycard, fob, wristband or the token, which is operable with readers throughout the game building. Access may be sold in blocks of several hours or several days, and the control system stores the access period, correlated to the keycard, fob, wristband or other token, in a database or on the token itself, and thereafter operates the various tracks and rooms to allow entry, or to function, only for teams gaining access with active tickets.

Physical access to the various rooms is controlled by the control system in conjunction with electromechanical locks operably connected to the doors. The various inputs regarding team activity in the various rooms may be obtained through various input devices and sensors, including touchscreens, computer keyboards and other computer input devices, and physical sensors of any description, including contact relays, motion sensors, inductive sensors, capacitive sensors, light sensors, photocells, etc. operably connected to various physical objects or structural features of the room. All actions of the game that are responsive to player actions may be controlled by the control system, or, if feasible, by human operators.

I claim:

1. A system for game play comprising:

a facility comprising at least one track comprising a plurality of task rooms that are each sequentially accessible along the at least one track by at least one team of at least one player;

wherein each task room of the plurality of task rooms has at least one locked door to control the access of the at least one team into each task room of the plurality of task rooms;

wherein each task room of the plurality of task rooms has at least one problem solving activity to be attempted by the at least one team; and wherein the at least one problem solving activity of each task room of the plurality of task rooms cannot be discerned prior to initial access into its task room;

a token for tracking teams and team actions; and a control system programmed to control access into each task room and to track team progress within the plurality of task rooms;

wherein access into an attached subsequent task room is permitted by unlocking the at least one locked door of an attached preceding task room of the plurality of task rooms when the team successfully completes the at least one problem solving activity in the attached preceding task room;

wherein access into the attached subsequent task room is barred by the at least one locked door of the attached preceding task room of the plurality of task rooms when the team fails to complete the task in the attached preceding task room;

wherein the control system tracks the team progress and team actions within each task room utilizing the token; and wherein the control system is further programmed to assess the success of a first team completing the at least one problem solving activity and to reconfigure the at least one problem solving activity in at least one task room of the plurality of task rooms based upon the assessed success of the first team to complete the at least one problem solving activity.

2. The system of claim 1, wherein the skill level of the team is assessed in a different task room than the at least one task room.

3. The system of claim 1, wherein the control system is further programmed to demand, as part of a solution in a task room of a first track, a token or information that the control system provides in response to successful completion of the at least one problem solving activity in a task room of a second track.

4. The system of claim 1, wherein the token for tracking teams further comprises a RFID tag.

5. The system of claim 1, further comprising a music system programmed to control at least one sound.

6. The system of claim 5, wherein the at least one sound further comprises a completion sound upon successful completion of the at least one problem solving activity.

7. The system of claim 5, wherein the at least one sound further comprises a failure sound upon failure to complete the at least one problem solving activity.

8. The system of claim 5, wherein the at least one sound changes in response to the progress of the at least one problem solving activity by the team.

9. The system of claim 5, wherein the at least one sound further comprises a disruption to increase the difficulty of completing the at least one problem solving activity.

10. The system of claim 5, wherein the at least one problem solving activity is a stepping sequence and the at least one sound changes in response to a step by the team.

11. The system of claim 5, wherein the at least one sound indicates progress has been made in the at least one problem solving activity.

12. The system of claim 11, wherein the at least one problem solving activity is assembling parts of a puzzle and the at least one sound indicates a part of the puzzle has been assembled.

13. The system of claim 1, wherein the control system is programmed to provide a clue to the team to help solve the task of at least one task room.

14. The system of claim 13, wherein the clue is a sound controlled by a sound distribution system.

15. The system of claim 1, wherein the at least one problem solving activity of at least one task room of the plurality of task rooms is altered after an ejection from the at least one task room such that the altered challenge cannot be discerned prior to a re-entrance.

16. The system of claim 1, wherein when access into the attached subsequent task room is barred by the at least one locked door of the attached preceding task room due to the team failing to complete the task in the attached preceding task room, an alternative door is opened to allow the team to egress from the attached preceding task room into a common area in order to retry the track having the attached preceding task room or pursue an alternative track.

17. The system of claim 1, wherein the at least one locked door is locked with an electromechanical lock.

18. The system of claim 1, wherein the control system is further programmed to reconfigure the at least one problem solving activity of at least one task room of the plurality of task rooms prior to entry by a first team when the control system detects that:

at least one member of the first team and at least one member of a second team are within a certain proximity; and the second team has already accessed the at least one task.

19. A system for game play comprising:

a facility comprising at least one track comprising a plurality of task rooms that are each sequentially accessible along the at least one track by at least one team of at least one player;

wherein each task room of the plurality of task rooms has at least one locked door to control the access of the at least one team into each task room of the plurality of task rooms;

wherein each task room of the plurality of task rooms has at least one problem solving activity to be attempted by the at least one team; and wherein the at least one problem solving activity of each task room of the plurality of task rooms cannot be discerned prior to initial access into its task room;

a token for tracking teams and team actions; and a control system programmed to control access into each task room and to track team progress within the plurality of task rooms;

wherein access into an attached subsequent task room is permitted by unlocking the at least one locked door of an attached preceding task room of the plurality of task rooms when the team successfully completes the at least one problem solving activity in the attached preceding task room;

wherein access into the attached subsequent task room is barred by the at least one locked door of the attached preceding task room of the plurality of task rooms when the team fails to complete the task in the attached preceding task room;

wherein the control system tracks the team progress and team actions within each task room utilizing the token;

and wherein the control system is further programmed to demand, as part of a solution in a task room of a first track, a token or information that the control system provides in response to successful completion of the at least one problem solving activity in a task room of a second track.

20. A system for game play comprising:

a facility comprising at least one track comprising a plurality of task rooms that are each sequentially accessible along the at least one track by at least one team of at least one player;

wherein each task room of the plurality of task rooms has at least one locked door to control the access of the at least one team into each task room of the plurality of task rooms;

wherein each task room of the plurality of task rooms has at least one problem solving activity to be attempted by the at least one team; and wherein the at least one problem solving activity of each task room of the plurality of task rooms cannot be discerned prior to initial access into its task room;

a token for tracking teams and team actions; and a control system programmed to control access into each task room and to track team progress within the plurality of task rooms;

wherein access into an attached subsequent task room is permitted by unlocking the at least one locked door of an attached preceding task room of the plurality of task rooms when the team successfully completes the at least one problem solving activity in the attached preceding task room;

wherein access into the attached subsequent task room is barred by the at least one locked door of the attached preceding task room of the plurality of task rooms when the team fails to complete the task in the attached preceding task room;

wherein the control system tracks the team progress and team actions within each task room utilizing the token; and wherein the control system is further programmed to reconfigure the at least one problem solving activity of at least one task room of the plurality of task rooms prior to entry by a first team when the control system detects that:

at least one member of the first team and at least one member of a second team are within a certain proximity; and the second team has already accessed the at least one task.

* * * * *